United States Patent [19]

Moses

[11] Patent Number: 4,865,135

[45] Date of Patent: Sep. 12, 1989

[54] TOP DRIVE TORQUE REACTOR

[75] Inventor: John K. Moses, Houston, Tex.

[73] Assignee: Hughes Tool Company, Houston, Tex.

[21] Appl. No.: 197,020

[22] Filed: May 20, 1988

[51] Int. Cl.[4] ..... E21B 3/02; E21B 12/00; E21B 19/16

[52] U.S. Cl. ..... 175/57; 173/164; 175/170; 175/195

[58] Field of Search ..... 175/170, 195, 57, 85; 173/164, 39, 42, 163, 12; 166/77.5

[56] References Cited

U.S. PATENT DOCUMENTS

| | | | |
|---|---|---|---|
| 2,568,959 | 9/1951 | Illies | 175/170 X |
| 2,998,084 | 8/1961 | Johnson et al. | 175/170 X |
| 3,012,619 | 12/1961 | Farque | 175/127 |
| 3,857,450 | 12/1974 | Guier | 175/85 |
| 3,874,196 | 4/1975 | Hisey et al. | 175/195 X |
| 3,920,087 | 11/1975 | Hisey et al. | 175/85 X |
| 4,458,768 | 7/1984 | Boyadjieff | 175/85 |
| 4,589,503 | 5/1986 | Johnson et al. | 175/113 |

*Primary Examiner*—Stephen J. Novosad
*Attorney, Agent, or Firm*—James E. Bradley

[57] ABSTRACT

A torque reactor for a top drive drilling rig converts reactive torque on the top drive housing into a rotational torque on a torque shaft. The torque shaft extends vertically in the derrick parallel with the drive stem. A torque case carries two bushings, one of the bushings receiving the drive stem of the top drive and the other slidingly receiving the torque shaft. The drive unit bushing is rigidly connected to the housing of the top drive. The torque shaft bushing will transmit rotational force to the torque shaft. Linkages interconnect the bushings. Rotational torque imposed on the drive unit bushing creates a rotational torque in the torque shaft bushing. That torque is transmitted to the torque shaft which is held stationary to absorb the torque.

5 Claims, 2 Drawing Sheets

TOP DRIVE TORQUE REACTOR

BACKGROUND OF THE INVENTION

1. Field of the Invention:

This invention relates in general to drilling rigs, and in particular to a mechanism for absorbing reactive torque from a power drive unit of a top drive drilling rig.

2. Description of the Prior Art:

In recent years, top drive drilling rigs have been introduced. In this type of drilling rig, the power to rotate the drill string is supplied by a drive unit in the derrick. The drive unit is supported by the blocks and includes an electrical motor. When the drive unit reaches the rig floor, three joints of drill pipe secured together can be connected between the upper end of the drill string and the drive unit. This speeds up the drilling process over the prior type that applied rotation at a rotary table on the rig floor.

As the power drive unit rotates the drill stem, a reaction torque will be imposed on the case or housing of the drive unit. The reaction torque will tend to cause the housing to rotate in a reverse direction to the drill stem. To accommodate this reaction torque and stabilize the drive unit, a pair of vertical braces or guide tracks are mounted in the derrick. A pair of rigid stabilizing arms are rigidly connected to the case. Each stabilizing arm will engage and slide on one of the guide tracks.

One disadvantage is that when converting a conventional rotary table driven drilling rig to a top drive drilling rig, extensive modifications are needed to the derrick. The guide tracks must be installed. Sometimes there is insufficient room to handle the top drive, support carriage, guide tracks and hang off mechanisms within the upper derrick structure. Also, the additional forces imparted to the derrick structure from the reaction torque are not wanted.

Another type of top drive drilling rig uses a drive shaft that extends vertically into the derrick. The drive shaft is driven at the rig floor. A carriage is supported by the blocks. The carriage has a sprocket that slidably receives the drive shaft and rotates with the drive shaft. The carriage also has a sprocket that rotates a drive stem for connection to the drill pipe. A chain extends around the sprockets to transmit the rotary force from the drive shaft to the drill stem.

This type of top drive unit does not have reactive torque imposed on the carriage. Consequently, it does not need vertical guide tracks. It does, however, require a drive transmission at the rig floor to drive the drive shaft.

SUMMARY OF THE INVENTION

In this invention, a vertical torque shaft is mounted in the drilling rig. The shaft is held stationary relative to the drilling rig. The top drive drilling rig has a power drive unit in the derrick. A pair of bushings are mounted in a torque case. One of the bushings is mounted to the housing of the top drive unit. The drive stem extends slidingly through the drive stem bushing and will rotate relative to this bushing. The other bushing is supported in the case and slidingly receives the torque shaft. Rotational force on the torque shaft bushing is imparted to the torque shaft.

A pair of linkages are connected between these two bushings. A reactive torque imposed on the drive stem bushing from the top drive unit housing will create a tensile force in one of the linkages, which in turn applies a rotational force on the torque shaft bushing. The rotational force on the torque shaft bushing is applied to the torque shaft, which is held stationary.

The linkage bars are pivotally or flexibly connected to the bushings so that they do not create a moment arm about the axis of the drive stem bushing. Nor will the linkage bars transmit any compression because of the pivotal connections. The tensile force in the linkage bar creates a compressive force in the case.

DESCRIPTION OF THE PREFERRED EMBODIMENT

Figure 1:
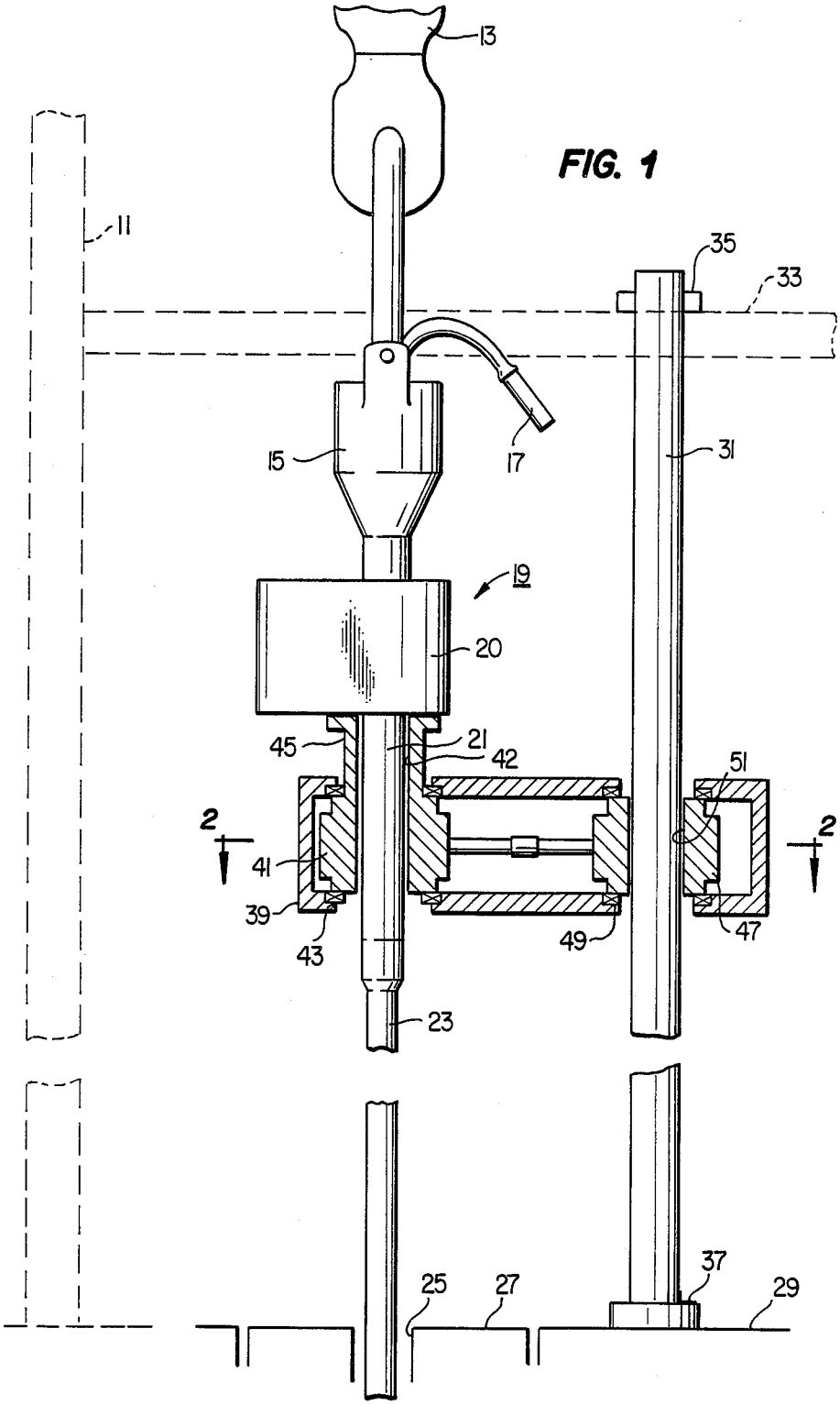
FIG. 1 is a schematic side view, partially sectioned, illustrating a top drive drilling rig constructed in accordance with this invention.

Referring to FIG. 1, a derrick 11 is shown schematically by dotted lines. The derrick 11 supports a set of blocks 13 which move up and down the derrick. The blocks 13 support a swivel 15, which is connected to a mud hose 17. The mud hose 17 will be connected to a source of drilling fluid.

A power drive unit 19 is also supported by the blocks 13, below the swivel 15 in the embodiment shown. Power drive unit 19 is conventional. It contains an electrical motor within a housing 20 which is supplied with electrical power from the drilling rig. Housing 20 also contains a drive mechanism connected to the electrical motor for rotating a drive stem 21. The drive stem 21 is adapted to be connected to the upper end of the string of drill pipe 23 and rotates relative to housing 20.

The drill pipe 23 extends through a hole 25 in the rotary table 27. The rotary table 27 is rotatably mounted to the rig floor 29. The rotary table 27 does not apply torque to the drill pipe 23 while the top drive unit 19 is operating.

A torque shaft 31 is vertically mounted in the derrick 11. Preferably, the torque shaft 31 will be mounted at its upper end to a brace 33 in the derrick 11. A nut 35 or other means will apply tension to the torque shaft 31 to increase its rigidity. The lower end of the torque shaft 31 is held by a coupling 37. When the top drive unit 19 is operating, coupling 37 will prevent any rotation of the torque shaft 31 relative to the rig floor 29.

A torque case 39 is carried in the derrick 11 below the housing 20. Torque case 39 has a drive stem bushing 41 contained within. Drive stem bushing 41 has a hole 42 extending through it for receiving the drive stem 21. The drive stem 21 will rotate relative to the drive stem bushing 41. The drive stem bushing 41 is mounted on bearings 43. Bearings 43 serve as means to prevent any rotational torque imposed on the drive stem bushing 41 from tending to rotate the case 39. Drive stem bushing 41 has a protruding neck 45 that protrudes upward from the case 39. Neck 45 is rigidly mounted to the housing 20 of the drive unit 19. Reactive torque on the housing 20 is applied to the drive stem bushing 41.

A torque shaft bushing 47 is also carried in the case 39, laterally outward from the drive stem bushing 41. Torque shaft bushing 47 is also carried on bearings 49 in the case 39. Bearings 49 serve as means to prevent any rotational torque imposed on the torque shaft bushing 47 from tending to rotate the case 39. The torque shaft bushing 47 has a hole 51 which receives the torque shaft 39. The axis of the hole 51 is parallel with the axis of the drive stem bushing hole 42.

The torque shaft 31 has a plurality of vertical splines or grooves 54 formed on it. Grooves 54 may be integrally formed in the shaft 31 or may be formed by bolting members to the shaft 31. Three rollers 52 are rotatably mounted to the torque shaft bushing 47. Each roller 52 has an edge or rim that bears against a shoulder of each groove 54. Torque in one direction transmits through the edges of the rollers 52 into the shoulders of the grooves 54 of the torque shaft 31. Torque in the opposite direction transmits through a side surface of each roller 52 to a groove 54.

Other rollers (not shown) will centralize the torque shaft 31 in the hole 51. The rollers 52 and grooves 54 serve as means for causing rotational torque imposed on the torque shaft bushing 47 to be applied to the torque shaft 31. The rollers 52 also serve as means to allow the case 39 to move up and down relative to the torque shaft 31.

Figure 2:
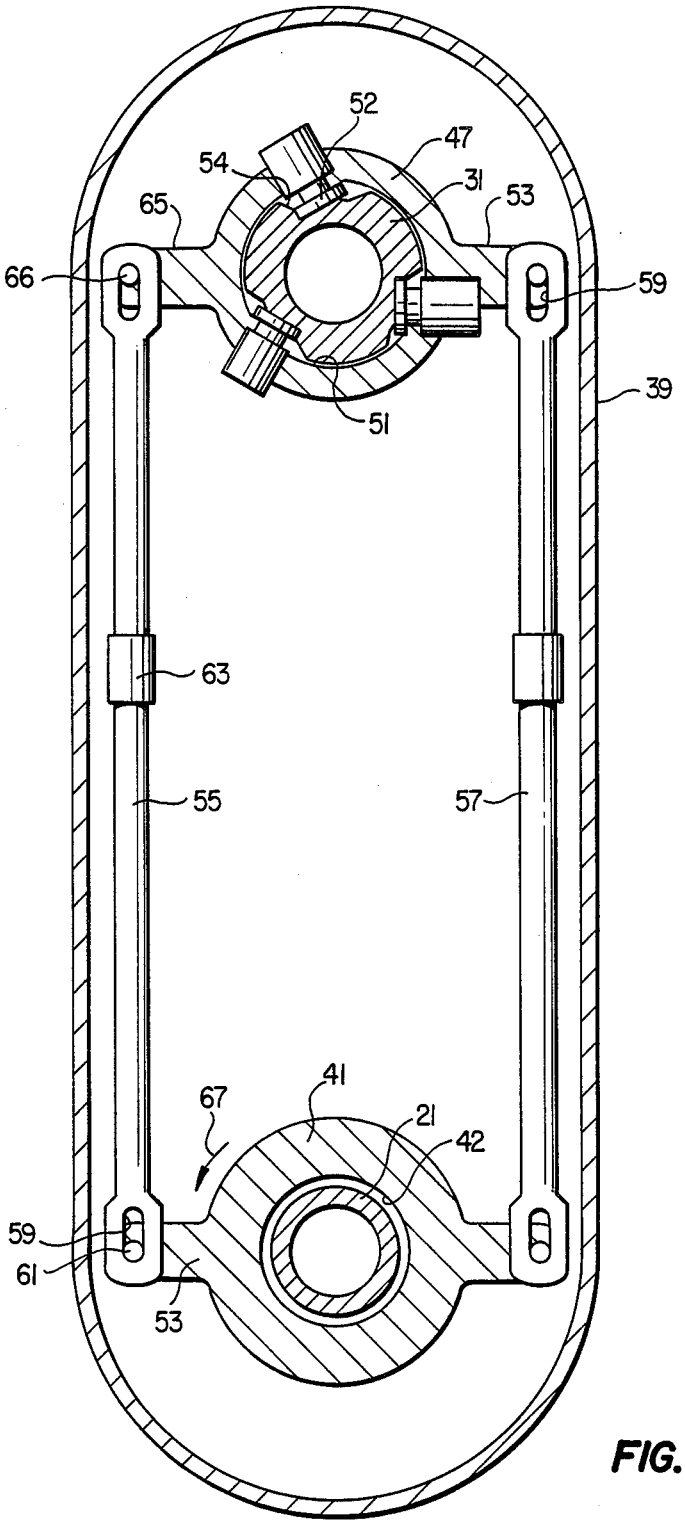
FIG. 2 is a vertical sectional view of the torque case of the top drive drilling unit of FIG. 1, taken along the line II—II.

Referring to FIG. 2, the drive stem bushing 41 has a pair of arms 53. Arms 53 protrude laterally outward 180 degrees apart from each other. A linkage bar 55 is pivotally connected to one of the arms 53, and a linkage bar 57 is pivotally connected to the other of the arms 53. Each linkage bar 55, 57 has an elongated hole 59 on each end. The hole 59 on one end fits over a pin 61 protruding from each arm 53. The elongated hole 59 and pin 61 provide a flexible connection means between the drive stem bushing 41 and the linkage bars 55, 57.

Each linkage bar 55, 57 is in two parts, connected together by an adjusting coupling 63. This adjusting coupling 63 allow the length of the linkage bars 55, 57 to be varied.

The torque shaft bushing 47 also has a pair of arms 65 which are similar to the arms 53. The arms 65 protrude laterally out 180 degrees apart from each other. Each arm 65 has a pin 66. The pin 66 receives the elongated hole 59 on the opposite end of each linkage bar 55, 57. The couplings 63 are adjusted so that the pins 61, 66 are located at opposite ends of the elongated holes 59. This assures that one of the linkage bars 55, 57 will be in tension when rotational force is applied to the drive stem bushing 41, regardless of the direction of the rotational force. Neither linkage bar 55, 57 will be under any compressive force at any time, regardless of the direction of the rotational force.

In operation, the drive unit 19 will rotate the drive stem 21. Assuming that the rotation is to the right, looking downward, this will create a reaction torque in the housing 20 in the opposite direction, as indicated by arrow 67 in FIG. 2. The rotational force on the housing 20 will be applied to the drive stem bushing 41. Drive stem bushing 41 will tend to rotate, applying tension to the linkage bar 55. Linkage bar 55 will transmit this tensional force through the pin 66 of arm 65 to the torque shaft bushing 47. The torque shaft bushing 47 will transmit the rotational force to the torque shaft 31 through the edges of the rollers 52 contacting the shoulders of the grooves 54. The torque shaft 31 will transmit the rotational force to the rig floor 29 (FIG. 1). The coupling 37 prevents the torque shaft 31 from rotating, and thus prevents the housing 20 from rotating.

The tension in the linkage bar 55 creates a compressive force within the torque case 39. The linkage bar 57 will be under no force at this point. It will not be in compression because of the elongated holes 59 in the ends of the linkage bar 57. It will not be under any tension because if the distance between the pins 61, 66 connecting the linkage bar 55 has increased a slight increment due to the tension imposed, there will be a corresponding incremental decrease in the distance between the pins 61, 65 connecting the linkage bar 57. There will be no lateral forces imposed on the torque shaft 31 by the reaction torque of the drive unit 19. As the top drive unit 19 moves downward during drilling, the case 39 will move with it, with the torque shaft bushing 47 moving downward on the torque shaft 31.

If the drive stem 21 is rotated in the reverse direction, such as during breakout, then the opposite will apply. The tension will be in the linkage bar 57 rather than linkage bar 55 as the drive stem bushing 41 will tend to rotate in the direction opposite to arrow 67. The rollers 52 will transmit the rotational force through their side surfaces to the grooves 54 of the torque shaft 31. The torque shaft 31 is held stationary by coupling 37 (FIG. 1).

If it is desired to move the drive unit 19 out of axial alignment with the rotary table 27 (FIG. 1) for other operations, such as for running casing, then this can be easily accommodated. The coupling 37 has means to allow it to be released from the rig floor 29. The operators on the rig floor 29 will rotate the torque shaft 31 with a wrench. Torque shaft bushing 47 will rotate with the torque shaft 31, causing the case 39 to rotate about the axis of the torque shaft 31. This will swing the entire case 39 and drive unit 19 out of the way.

The invention has significant advantages. The torque reactor can be easily installed to existing conventional rigs being converted to top drive. The conversion requires less modification to the derrick than the guide track top drive type. Adequate room is available in most drilling rigs for the torque case and torque shaft. There are no lateral forces imposed in the derrick. Rather, the reacting torque on the housing creates a rotational torque in a single stationary torque shaft.

While the invention has been shown in only one of its forms, it should be apparent to those skilled in the art that it is not so limited, but is susceptible to various changes without departing from the scope of the invention.

I claim:

1. In a top drive drilling rig of the type having a drive unit carried in a derrick, the drive unit having a housing and a drive stem to which a string of drill pipe is adapted to be connected, the drive stem being rotated by the drive unit relative to the housing for rotating the string of drill pipe, an improved means for absorbing reactive torque on the housing, comprising:

a torque shaft mounted vertically to the drilling rig adjacent to the drive stem;

means for preventing rotation of the torque shaft relative to the drilling rig;

a torque shaft bushing which receives the torque shaft;

means cooperating with the torque shaft bushing and torque shaft for allowing the torque shaft bushing to move vertically relative to the torque shaft, but preventing rotation of the torque shaft bushing relative to the torque shaft; and a pair of linkages carried by the housing on opposite sides of the housing and extending to opposite sides of the torque shaft bushing for transmitting reactive torque on the housing to the torque shaft bushing, which in turn transmits the reactive torque to the torque shaft to prevent the housing from rotating as the drive stem rotates.

2. In a top drive drilling rig of the type having a drive unit carried in a derrick for vertical movement relative to the derrick, the drive unit having a housing and a drive stem to which a string of drill pipe is adapted to be connected, the drive stem being rotated by the drive unit relative to the housing for rotating the string of drill pipe, an improved means for absorbing reactive torque on the housing, comprising:

a torque shaft mounted vertically to the drilling rig adjacent to the drive stem;

means for preventing rotation of the torque shaft relative to the drilling rig;

a rigid case carried by the housing for vertical movement therewith, and extending laterally outward from the housing;

a torque shaft bushing mounted to the case, the torque shaft bushing having a hole for receiving the torque shaft;

means cooperating with the torque shaft bushing and torque shaft for allowing the torque shaft bushing to move vertically relative to the torque shaft, but preventing rotation of the torque shaft bushing relative to the torque shaft; and a pair of linkages carried by the housing on opposite sides of the housing and extending to opposite sides of the torque shaft bushing for transmitting reactive torque on the housing to the torque shaft bushing, which in turn transmits the reactive torque to the torque shaft to prevent the housing from rotating as the drive stem rotates.

3. For use in a top drive drilling rig of the type having a drive unit carried in a derrick for vertical movement relative to the derrick, the drive unit having a housing and a drive stem to which a string of drill pipe is adapted to be connected, the drive stem being rotated by the drive unit relative to the housing for rotating the string of drill pipe, an improved means for absorbing reactive torque on the housing, comprising:

a torque shaft adapted to be mounted vertically to the drilling rig adjacent to the drive stem;

means for preventing rotation of the torque shaft relative to the drilling rig;

a drive stem bushing adapted to be mounted to the housing, having a hole through which the drive stem is adapted to pass, the drive stem being rotatable relative to the drive stem bushing;

a case mounted to the drive stem bushing;

a torque shaft bushing mounted to the case, the torque shaft bushing having a hole for receiving the torque shaft;

means cooperating with the torque shaft bushing and torque shaft for allowing the torque shaft bushing to move vertically relative to the torque shaft, but preventing rotation of the torque shaft bushing relative to the torque shaft; and linkage means extending from opposite sides of the drive stem bushing to opposite sides of the torque shaft bushing for transmitting reactive torque on the housing to the torque shaft bushing, which in turn transmits the reactive torque to the torque shaft to prevent the housing from rotating in an opposite direction to the drive stem as the drive unit rotates the drive stem.

4. An apparatus for use with a drilling rig for rotating a string of drill pipe, the drilling rig having a derrick, the apparatus comprising in combination:

a drive unit adapted to be carried by the derrick for vertical movement relative to the derrick, the drive unit having a housing and a drive stem to which a string of drill pipe is adapted to be connected, the drive stem being rotatable by the drive unit relative to the housing for rotating the string of drill pipe;

a torque shaft adapted to be mounted vertically to the drilling rig adjacent to the drive stem, the torque shaft being mounted to the drilling rig so as to be selectively nonrotatable relative to the drilling rig;

a drive stem bushing rigidly mounted to the housing, having a hole through which the drive stem is adapted to pass, the drive stem being rotatable relative to the drive stem bushing;

a case;

means for mounting the drive stem bushing to the case for preventing any rotational torque on the drive stem bushing from tending to rotate the case;

a torque shaft bushing, the bushing having a hole for receiving the torque shaft, the torque shaft bushing being nonrotatable but vertically movable relative to the torque shaft;

means for mounting the torque shaft bushing to the case for preventing any rotational torque on the torque shaft bushing from tending to rotate the case and;

a pair of linkages, each extending from opposite sides of the drive stem bushing to opposite sides of the torque shaft bushing, one of the linkages being tensionable by exerting a rotational force in a first direction on the drive stem bushing for transmitting a rotational force on the drive stem bushing to the torque shaft bushing, which in turn applies the rotational force to the torque shaft, which is held stationary to prevent the housing from rotating in reverse to the drive stem as the drive unit rotates the drive stem, the other of the linkages being tensionable by exerting a rotational force in a second direction on the drive stem bushing, the linkages being connected with the bushings so as to be incapable of transmitting a compressive force due to rotational forces on the drive stem bushing in the first and second directions.

5. An improved method for absorbing reactive torque on the housing of a drive unit of a top drive drilling rig, the drive unit having a housing and a drive stem to which a string of drill pipe is adapted to be connected, comprising in combination:

mounting a torque shaft vertically to the drilling rig adjacent to the drive stem;

preventing rotation of the torque shaft relative to the drilling rig;

nonrotatably mounting a torque shaft bushing to the torque shaft so as to be vertically movable relative to the torque shaft;

carrying the torque shaft bushing with the housing for vertical movement with the housing;

connecting a pair of linkages between opposite sides of the housing to opposite sides of the bushing; and rotating the drive stem with the drive unit, and transmitting reactive torque on the housing to the bushing through the linkages, which in turn transmits the reactive torque to the torque shaft to prevent the housing from rotating as the drive stem rotates.

* * * * *